United States Patent [19]

Massey

[11] 4,211,266

[45] Jul. 8, 1980

[54] FLEXIBLE CONTAINER WITH DISCHARGE TUBE

[75] Inventor: Frederick Massey, Cleethorpes, England

[73] Assignee: Tioxide Group Limited, Billingham, England

[21] Appl. No.: 13,682

[22] Filed: Feb. 21, 1979

[30] Foreign Application Priority Data

Feb. 23, 1978 [GB] United Kingdom ..... 07192/78
Sep. 16, 1978 [GB] United Kingdom ..... 37087/78

[51] Int. Cl.[2] ..... B65D 33/38
[52] U.S. Cl. ..... 150/1; 222/181; 222/507
[58] Field of Search ..... 150/0.5, 1; 222/181, 222/185, 507, 105

[56] References Cited

U.S. PATENT DOCUMENTS

| | | | |
|---|---|---|---|
| 1,431,918 | 10/1922 | Arthur | 222/507 UX |
| 2,663,467 | 12/1953 | Douglass | 222/507 |
| 2,846,179 | 8/1958 | Monckton | 222/507 X |
| 3,742,664 | 7/1973 | Reding | 222/185 X |
| 3,961,655 | 6/1976 | Nattrass | 150/1 |
| 4,143,796 | 3/1979 | Williamson | 150/1 X |

*Primary Examiner*—Donald F. Norton
*Attorney, Agent, or Firm*—Schuyler, Birch, McKie & Beckett

[57] ABSTRACT

A container consisting of a flexible body, base and cover and having flexible discharge and filling tubes in the base and cover, respectively, and flaps attached to the exterior of the base; the discharge and filling tubes and flaps having releasable securing means. The container may be provided with means to control the rate of discharge of the contents of the container from the discharge tube.

14 Claims, 2 Drawing Figures

FLEXIBLE CONTAINER WITH DISCHARGE TUBE

Figure 1:
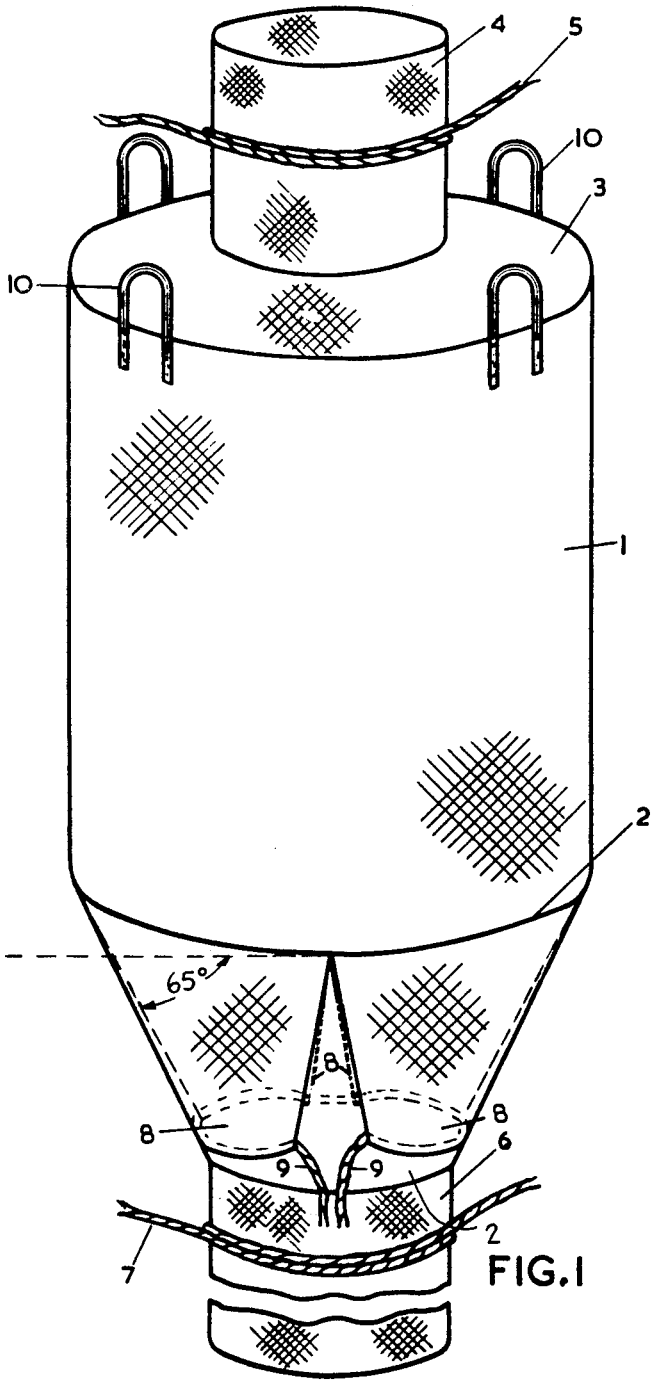

The present invention relates to an improved container for the transport and delivery of finely divided solids, for example of pigmentary titantium dioxide.

It has hitherto been common practice to pack, transport and deliver finely divided solids such as pigmentary titanium dioxide in separate sealed bags, normally of multi-ply paper and which contain a convenient weight of product for manual handling by the operator, for example of 25 Kilograms. Transport and delivery of quantities of solid in excess of the weight of one bag are normally undertaken by stacking the appropriate number of bags on a wooden pallette. Such loaded pallettes are conveniently moved by mechanical handling equipment, for example by a fork lift truck.

However, the use of relatively small sacks is inconvenient in that the user has to open each sack prior to discharge of its contents with consequent waste of time and effort. Furthermore, such excessive handling may cause dust problems. Also, the disposal of a large number of emptied bags (which normally contain residual finely divided solid) and of the wooden pallettes (which normally require storage prior to return to the sender) also present difficulties. Where pallettes are not returned to the sender, as frequently happens, the supply of replacement pallettes is a substantial cost to the manufacturer.

The foregoing difficulties in the packing, transport and discharge of finely divided solids has caused the manufacturers of such solids to use alternative forms of containers which contain a substantially greater amount of solid and which are designed for mechanical handling and discharge. Such a container is described, for example, in British Pat. No. 1,340,693. These containers normally comprise a flexible cylindrical upper portion and a flexible lower portion formed as an inverted truncated cone terminating in a base outlet. In use, the outlet is closed and is collapsed on a flat surface during the filling and transport of the container. During discharge the container is lifted so that the truncated cone is extended by the weight of the contained solid and the base outlet is then opened to allow the solid to be discharged.

Such containers suffer certain disadvantages, particularly in the handling of materials such as pigmentary titanium dioxide, in that the containers must normally be retained on a flat surface during filling and transport in order to support the lower half of the container and this part of the container is normally not adequately protected during filling and/or transport nor is the angle taken up by the lower half of the container during discharge adequately supported. Furthermore, such containers have no means whereby the rate of discharge may be controlled. Both these features are of considerable importance, particularly in the discharge of materials such as pigmentary titanium dioxide where the angle of the base of the container during discharge is important in determining the efficiency of discharge and the control of the rate of discharge enables the contents of the container to be discharged at a controlled rate directly into the vessel in which the contents are to be used, for example a mixing vessel.

It is an object of the present invention to provide a container which overcomes or at least reduces these existing problems.

Accordingly, the present invention is a container comprising a surrounding wall, a cover and a base, both wall, base and cover being of flexible material, the base and cover being provided with flexible tubes having releasable closure means; a plurality of flaps attached externally to the base by one side and the free sides of which are provided with releasable connecting means whereby the flaps can be secured over the flexible discharge tube and means for lifting the container.

The surrounding wall, which is preferably cylindrical when the container is full, the base and the cover are normally made from the same material and are preferably secured to each other by forming at least the surrounding wall of the container and the base from a number of separate pieces cut longitudinally and sewn in such a manner that at least the surrounding wall and base of the container have no horizontal seam.

Alternatively, the container may be formed by conventional means such as by sewing the periphery of the base and cover to opposite edges of the surrounding wall of the container but this results in a container which is less strong than one formed by the preferred method referred to above.

One very suitable material, both from the point of view of strength and cost, is a woven cloth of polypropylene filaments, the filaments being coated with a mixture of polypropylene and polyethylene. The cloth is suitably woven to prevent leaking of the contents and of suitable filament thickness, for example of about 1000 denier, to provide the necessary strength.

It has also been found that such a material resists staining, has excellent retaining properties for pigmentary $TiO_2$ and does not show too great an affinity for the contents during emptying. Materials such a polyvinylchloride-covered polyester filaments and/or rubber covered nylon fabric have been found to be more expensive and are not preferred.

The base of the container is preferably attached to the lower edge of the wall of the container in such a manner and is so constructed that when the contents are being discharged, the base assumes an angle of between 55° and 75° and preferably an angle between 60° and 70°, with the horizontal plane across the base of the surrounding wall of the container. It has been found that such an angle is particularly suitable in assisting the discharge of pigmentary titanium dioxide from the container via the discharge tube.

The flexible tubes in the base and cover are, respectively, discharge and filling tubes for the container and are normally of the same type of material as the container but woven from smaller diameter filaments to give greater flexibility. Both tubes are normally provided with tie-cords as the releasable closure means.

It may be desirable to provide in the cover, in addition to the flexible filling tube, a second tube which is adapted to be connected to a dust removing means.

The flaps on the base are conveniently releasably interconnected by doubling over and sewing a portion of the free side of the flaps to form a passage-way for a draw-string which, when tightened and tied, retains the flaps in position against the base thereby protecting the discharge tube from damage during handling and/or during transport. When released it is preferred that the flaps, which are conveniently quadrant in shape, form a cone-like structure which assists in supporting the base and in directing the discharge of the material, for example pigmentary titanium dioxide.

The presence of the flaps has a number of advantages. One is that stability of the container is improved, for example when standing on a flat surface, since a flatter base is provided when the flaps are secured in position over the discharge tube. Another advantage is that on release of the flaps mass flow of the finely divided solid material is established and it has been found that even compacted material flows satisfactorily due to the movement of the base of the container on release of the flaps. Additionally, it is preferred to strengthen and reinforce the flaps, for example by the incorporation of a material such as polyvinylchloride fabric. This has the advantages of increased resistance to wear and the increased stiffness assists in supporting the base at the desired angle during the discharge of the contents from the container.

The provision of flaps, when secured, also substantially reduces the amount of head room required when the containers are being manoeuvred since the base and discharge tube are then contained within the flatter lower surface formed by the flaps.

In order to control the rate of discharge from the container it has been found convenient to provide the discharge tube with rings of rigid material spaced along the tube. These may be provided with externally directed handles whereby the rings may be twisted in opposite directions to restrict the internal cross section of the discharge tube, thereby controlling the discharge rate of solid through the tube.

If desired, the rings may be secured to the wall of the tube, for example by sewing to form a permanent feature of the container. Alternatively, two rings of difficulty deformable material, for example of mild steel or a hard polymer, may be suspended from the surrounding wall or from the base of the container in such a manner that the rings surround the discharge tube when the latter is extended. Conveniently, the rings may be suspended from loops or the like attached to the surrounding wall or base of the container by flexible cords, for example of plaited nylon or of polypropylene filaments. The rings are suspended in such a manner that one is positioned above the other and conveniently about the mid-point of the discharge tube. Normally, the lower ring is separated from, and inter-connected to, the upper ring by flexible cords of similar type to those used for suspending the upper ring from the wall or base of the container. Usually, four cords (and loops for their attachment to the container) are provided but this number may be varied as desired. The rings are separated from each other by a sufficient distance to allow one ring to be rotated with respect to the other ring in such a manner as to reduce the internal cross section of the discharge tube. One or both rings may be provided with an externally-directed handle to facilitate rotation of the ring(s). Restriction of the internal cross section of the discharge tube (and consequent limitation of the rate of discharge) is brought about by pressure of the cords on the discharge tube as the ring(s) is rotated in the horizontal plane.

Preferably, the rings are releasably connected to the wall or base of the container so that they can be removed and re-used on other containers. However, even if the rings are permanently fixed to the container, the resulting container is cheaper than one having rings sewn into the wall of the discharge tube since the sewing operation increases the cost of the containers.

One embodiment of the present invention comprises a container the side, base and cover of which are woven from 1000 denier polypropylene filaments coated with a mixed polypropylene (80%) polyethylene (20%) composition.

The container is, when extended, approximately 40" in diameter, 45" in depth (from cover to base) and is provided with flexible filling and discharge tubes 18" in diameter, at the centres of the cover and base. These tubes are made of woven polypropylene cloth similar to that of the remainder of the container but of smaller diameter filaments to give increased flexibility. Cords are provided to tie off the tubes when the container is full.

Equidistantly around the periphery of the base of the container are sewn the base side of four flaps of quadrant shape, the apexes of which are doubled over and sewn to form a passage for a draw string which, when tightened and tied, retains the flaps firmly in position against the base and which protects the discharge tube. When released and during discharge the base forms an angle of approximately 65° with the horizontal plane across the base of the surrounding wall of the container and is supported to some extent in this position by the flaps.

To the outside of the surrounding wall of the container are sewn four looped handles whereby the container can be lifted, for example by means of a fork lift truck.

Another embodiment of the present invention comprises a container similar to that described in the previous embodiment in which two mild steel rings ⅜" in diameter are suspended by four cords of plaited polypropylene filaments from loops sewn on the surrounding wall of the container and hanging respectively 30" and 42" below the lower edge of the surrounding wall of the container and which surround the discharge tube, when extended, at a distance of 12" and 24" respectively below the junction of the discharge tube and the base of the container.

Figure 2:
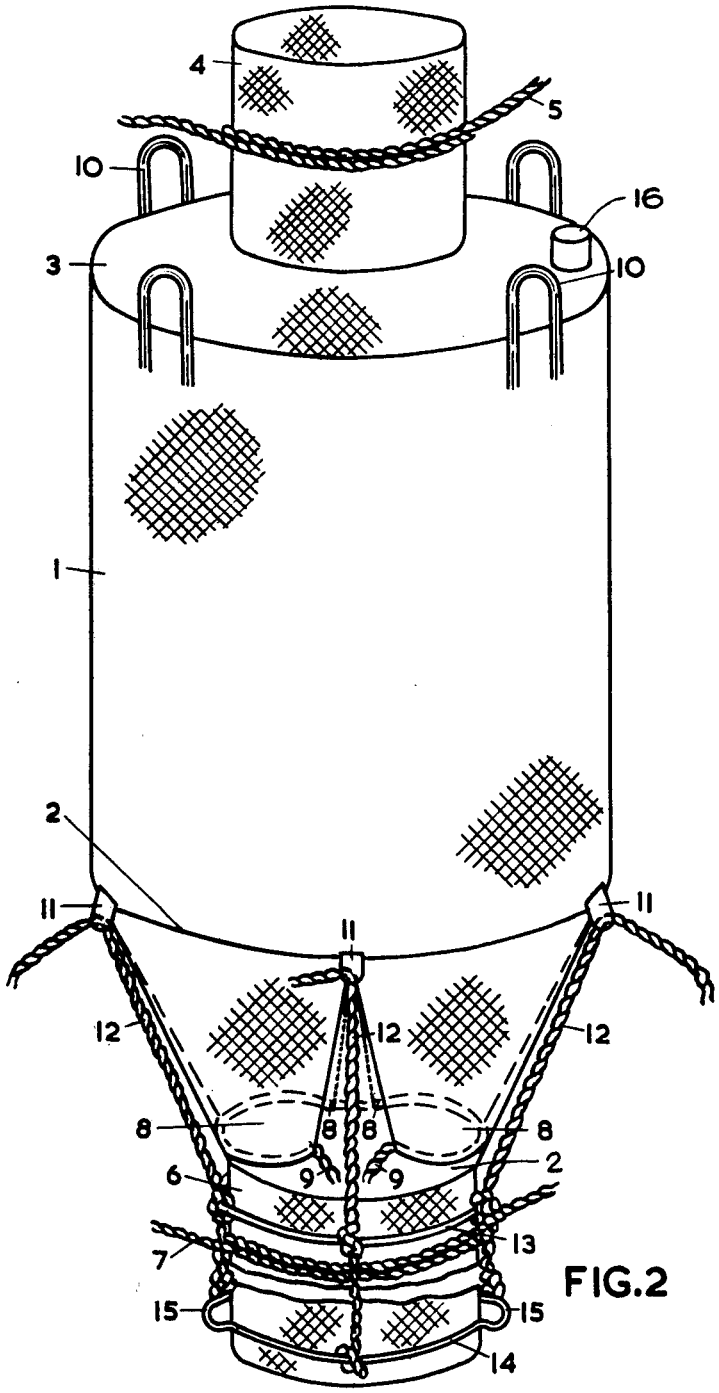

FIGS. 1 and 2 accompanying this specification show embodiments of the invention previously described.

In FIG. 1 there is shown a surrounding wall (1) fixed to base (2) and cover (3). The cover is provded with a flexible filling tube (4) and tie cord (5) and the base is provided with a discharge tube (6) and the cord (7). Four flaps (8) are provided and interconnected by draw string (9). Lifting handles (10) are also shown.

In FIG. 2 the parts common to FIG. 1 are similarly numbered. In addition, there are loops (11), of which only three of four are shown, to which are tied cords (12) which suspend rings (13) and (14) to encircle the discharge tube (6). Ring (14) is provided with handles (15) to facilitate its rotation with respect to ring (13). Tube (16) is adapted to be connected to a dust removing means not shown.

In use the containers of FIGS. 1 and 2 are suspended above the receiving vessel, the draw string on the flaps is then released and the discharge tube extended and the contents released on untying the tie cord.

In FIG. 2 the rings are suspended to encircle the discharge tube, the tie cord on the discharge tube is released and the rate of discharge is controlled by rotating the rings with respect to each other.

I claim:

1. A container comprising a closed sidewall, a cover and a base; said sidewall, base and cover being of flexible material, said base being provided with a flexible discharge tube and said cover being provided with a flexible filling tube, said flexible tubes having releaseable closure means, said base and sidewall being constructed in such a manner that said base assumes an angle of between 55° and 75° to the horizontal plane across the base of the sidewall of said container during discharge of its contents; a plurality of flaps attached externally to said base by one side and the free sides of which are provided with releasable connecting means whereby said flaps can be secured over said flexible discharge tube; and means for lifting said container.

2. A container as claimed in claim 1 made from woven polypropylene filaments.

3. A container as claimed in claim 2 wherein the polypropylene filaments are coated with a mixture of polypropylene and polyethylene.

4. A container as claimed in claim 2 where in filaments forming the sidewall, base and cover are of about 1000 denier.

5. A container as claimed in claim 2 wherein the filaments from which the filling and discharge tubes are formed are of smaller diameter than those forming the sidewall, base and cover.

6. A container as claimed in claim 1 wherein the base assumes an angle of between 60° and 70° to the horizontal plane across the base of the sidewall of the container during discharge.

7. A container as claimed in claim 1 wherein the base is supported at an angle of between 55° and 75° by the flaps which are attached externally to the base.

8. A container as claimed in claim 1 wherein the cover is also provided with a second tube suitable for connection to dust removal means.

9. A container as claimed in claim 1 wherein the discharge tube is provided with rings of rigid material spaced along its length.

10. A container as claimed in claim 9 wherein the rings are secured to the wall of the discharge tube.

11. A container as claimed in claim 9 wherein the rings are suspended from the lower part of the sidewall of the container by means of a number of flexible cords.

12. A container as claimed in claim 9 wherein at least one of the rings is provided with an externally-directed handle.

13. A container comprising a closed sidewall, a cover and a base, said sidewall, base and cover being of flexible material made from woven polypropylene filaments, said base being provided with a flexible discharge tube and said cover being provided with a flexible filling tube, said flexible tubes having releaseable closure means, and the filaments from which said filling and discharge tubes are formed being of smaller diameter than those forming said sidewalls, base and cover; a plurality of flaps attached externally to said base by one side and the free sides of which are provided with releaseable connecting means whereby said flaps can be secured over said flexible discharge tube; and means for lifting said container.

14. A container comprising a closed sidewall, a cover and a base, said sidewall, base and cover being of flexible material, said base being provided with a flexible discharge tube and said cover being provided with a flexible filling tube, said flexible tubes having releaseable closure means; a plurality of flaps attached externally to said base by one side and the free sides of which are provided with releaseable connecting means whereby said flaps can be secured over said flexible discharge tube, said discharge tube being provided with rings of rigid material spaced along its length, said rings being suspended from the lower part of said sidewall of said container by means of a number of flexible cords; and means for lifting said container.

* * * * *